US005704523A

United States Patent [19]

Wang

[11] Patent Number: 5,704,523

[45] Date of Patent: Jan. 6, 1998

[54] FOLDABLE BABY CARRIER

[76] Inventor: Hsiu Yen Wang, No. 15, Lane 31, Fu Chiang Rd., Hsin Shih Hsiang, Tainan Hsien, Taiwan

[21] Appl. No.: 708,626

[22] Filed: Sep. 5, 1996

[51] Int. Cl.[6] ..... A61G 1/00

[52] U.S. Cl. ..... 224/161; 224/158; 280/30; 280/643

[58] Field of Search ..... 224/158, 159, 224/160, 161; 280/30, 642, 643, 47.371

[56] References Cited

U.S. PATENT DOCUMENTS

| | | | |
|---|---|---|---|
| 3,989,173 | 11/1976 | Gebhard | 224/161 |
| 4,044,931 | 8/1977 | Catelli | 224/161 |
| 4,542,916 | 9/1985 | Kassai | 280/642 |
| 4,545,599 | 10/1985 | Kassai | 280/642 |
| 4,747,526 | 5/1988 | Launes | 224/161 |

FOREIGN PATENT DOCUMENTS

| | | | |
|---|---|---|---|
| 239367 | 9/1987 | European Pat. Off. | 280/642 |
| 2179897 | 3/1987 | United Kingdom | 280/642 |

*Primary Examiner*—Henry J. Fecla
*Assistant Examiner*—Gregory M. Vidovich
*Attorney, Agent, or Firm*—Pro-Techtor International

[57] ABSTRACT

A foldable baby carrier includes first and second support rods, a U-shaped upper frame, a U-shaped lower frame, first and second upper joints, and first and second lower joints. The first support rod has an upper end and a lower end. The first end of the U-shaped upper frame and the upper end of the first support rod are connected to the first upper joint. The second end of the U-shaped upper frame and the upper end of the second support rod are connected to the second upper joint. The first lower joint is disposed on a middle portion of the first support rod. The second lower joint is disposed on a middle portion of the second support rod. The first end of the U-shaped lower frame is connected to the first lower joint. The second end of the U-shaped lower frame is connected to the second lower joint. A foldable rod has a first end and a second end. The first end of the foldable rod is connected to a lower portion of the first support rod. The second end of the foldable rod is connected to a lower portion of the second support rod.

3 Claims, 9 Drawing Sheets

FOLDABLE BABY CARRIER

BACKGROUND OF THE INVENTION

The invention relates to a foldable carrier. More particularly, the invention relates to a foldable carrier for carrying a baby.

Referring to FIGS. 1 and 2, a conventional baby carrier has two main supports 17, two upper joints 11 disposed on the upper ends of the main supports 17 respectively, two second joints 18 disposed on the lower portions of the main supports 17 respectively, two ends of a first U-shaped frame 16 connected to two first joints 11, and two ends of a second U-shaped frame 19 connected to two second joints 18. Each of the upper joints 11 has a block 14 and a spring 13. A control plate 12 is disposed on the main support 17 and connected to the spring 13. However, it is not convenient to move the control plate 12. The finger of the user may be clipped by the spring 13 while moving the control plate 12. Furthermore, the first joint 11 and the first U-shaped frame 16 are fastened together by rivets 15. A seat pad surrounds the U-shaped frame 16, and a plurality of rivets 15 pass through the seat pad, the U-shaped frame 16 and the first joint 11. Therefore, the seat pad cannot be detached to clean.

SUMMARY OF THE INVENTION

An object of the invention is to provide a foldable baby carrier which is easily folded.

Another object of the invention is to provide a foldable baby carrier which can be used safely.

Accordingly, a foldable baby carrier comprises first and second support rods, a U-shaped upper frame, a U-shaped lower frame, first and second upper joints, and first and second lower joints. The U-shaped upper frame has a first end and a second end. The first support rod has an upper end and a lower end. The second support rod has an upper end and a lower end. The first end of the U-shaped upper frame and the upper end of the first support rod are connected to the first upper joint. The second end of the U-shaped upper frame and the upper end of the second support rod are connected to the second upper joint. The U-shaped lower frame has a first end and a second end. The first lower joint is disposed on a middle portion of the first support rod. The second lower joint is disposed on a middle portion of the second support rod. The first end of the U-shaped lower frame is connected to the first lower joint. The second end of the U-shaped lower frame is connected to the second lower joint. A first protective sleeve encloses the first end of the U-shaped upper frame. A first block is disposed in the first protective sleeve. The first protective sleeve and the first end of the U-shaped upper frame are fastened by a first rivet. A second protective sleeve encloses the second end of the U-shaped upper frame. A second block is disposed in the second protective sleeve. The second protective sleeve and the second end of the U-shaped upper frame are fastened by a second rivet. A first foldable rod is disposed in a middle portion of the U-shaped upper frame. A second foldable rod is disposed in a middle portion of the U-shaped lower frame. A third foldable rod has a first end and a second end. The first end of the third foldable rod is connected to a lower portion of the first support rod. The second end of the third foldable rod is connected to a lower portion of the second support rod. Each of the first, second and third foldable rods has a main shaft, and first and second auxiliary shafts. Each main shaft has a first pivot end and a second pivot end. Each first auxiliary shaft has a third pivot end. Each second auxiliary shaft has a fourth pivot end. Each first pivot end has a first protruded block portion. Each second pivot end has a second protruded block portion. Each third pivot end has first and second stopper portions. Each fourth pivot end has third and fourth stopper portions. Each first pivot end is connected to each corresponding third pivot end pivotally. Each second pivot end is connected to each corresponding fourth pivot end pivotally. A first slide sleeve encloses the upper end of the first support rod. A second slide sleeve encloses the upper end of the second support rod. A first protrusion is disposed on a top portion of the first slide sleeve. A first contact plate is disposed on a lower end of the first slide sleeve. A first slide slot is formed on the first slide sleeve. First and second block plates extend downward from the top portion of the first slide sleeve. A first elastic element is inserted in the first slide sleeve. A second slide slot is formed on the second slide sleeve. Third and fourth block plates extend downward from the top portion of the second slide sleeve. A second elastic element is inserted in the second slide sleeve. The first slide sleeve and the first support rod are fastened by a first fastening element. The second slide sleeve and the second support rod are fastened by a second fastening element. The first upper joint has a first groove to receive the first protective sleeve and a second groove to receive the first slide sleeve. The second upper joint has a third groove to receive the second protective sleeve and a fourth groove to receive the second slide sleeve. A first threaded rod passes through the first block to fasten the first upper joint and the first protective sleeve together. A first threaded bar passes through the first slide slot to fasten the first upper joint, the first support rod and the first slide sleeve together. A second threaded rod passes through the second block to fasten the second upper joint and the second protective sleeve together. A second threaded bar passes through the second slide slot to fasten the second upper joint, the second support rod and the second slide sleeve together.

DETAILED DESCRIPTION OF THE INVENTION

Figure 1:
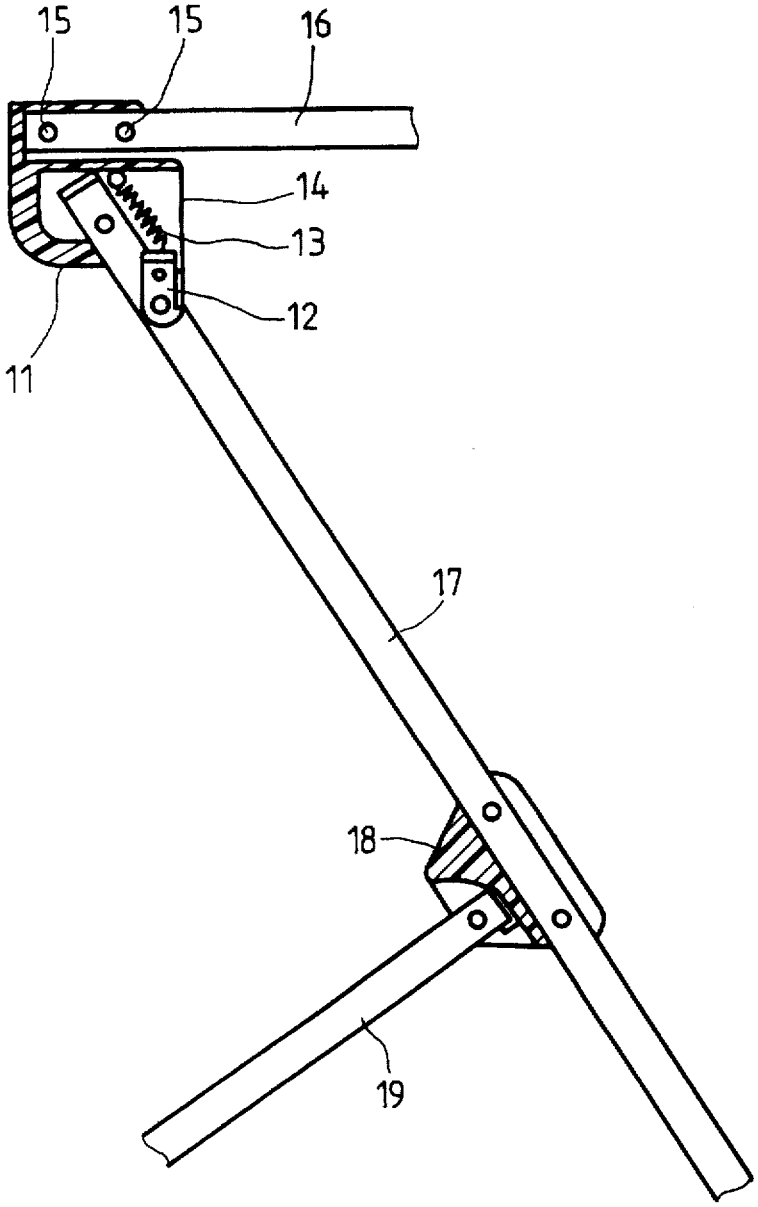
FIG.1 (PRIOR ART)
FIG. 1 is a partially sectional view of a baby carrier of the prior art.
Figure 2:
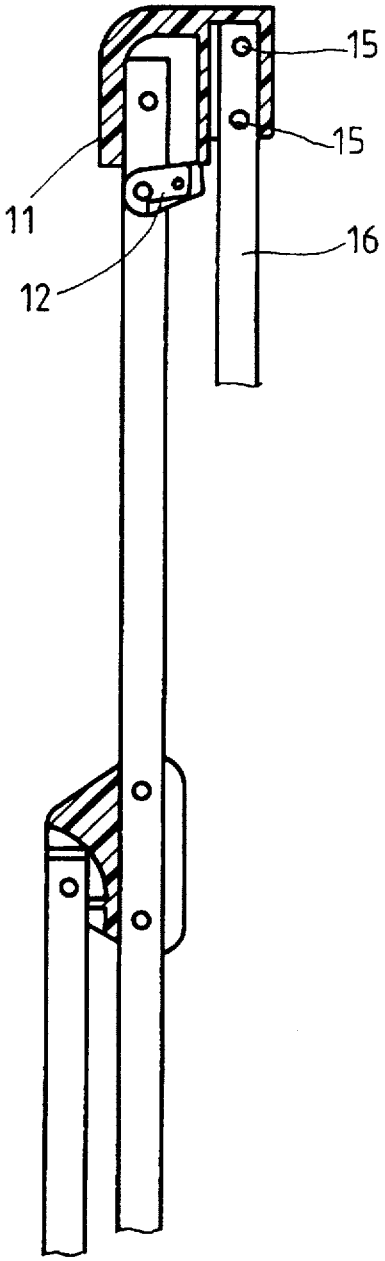
FIG. 2 (PRIOR ART)
FIG. 2 is a partially sectional view of a baby carrier of the prior art while the baby carrier is folded.
Figure 3:
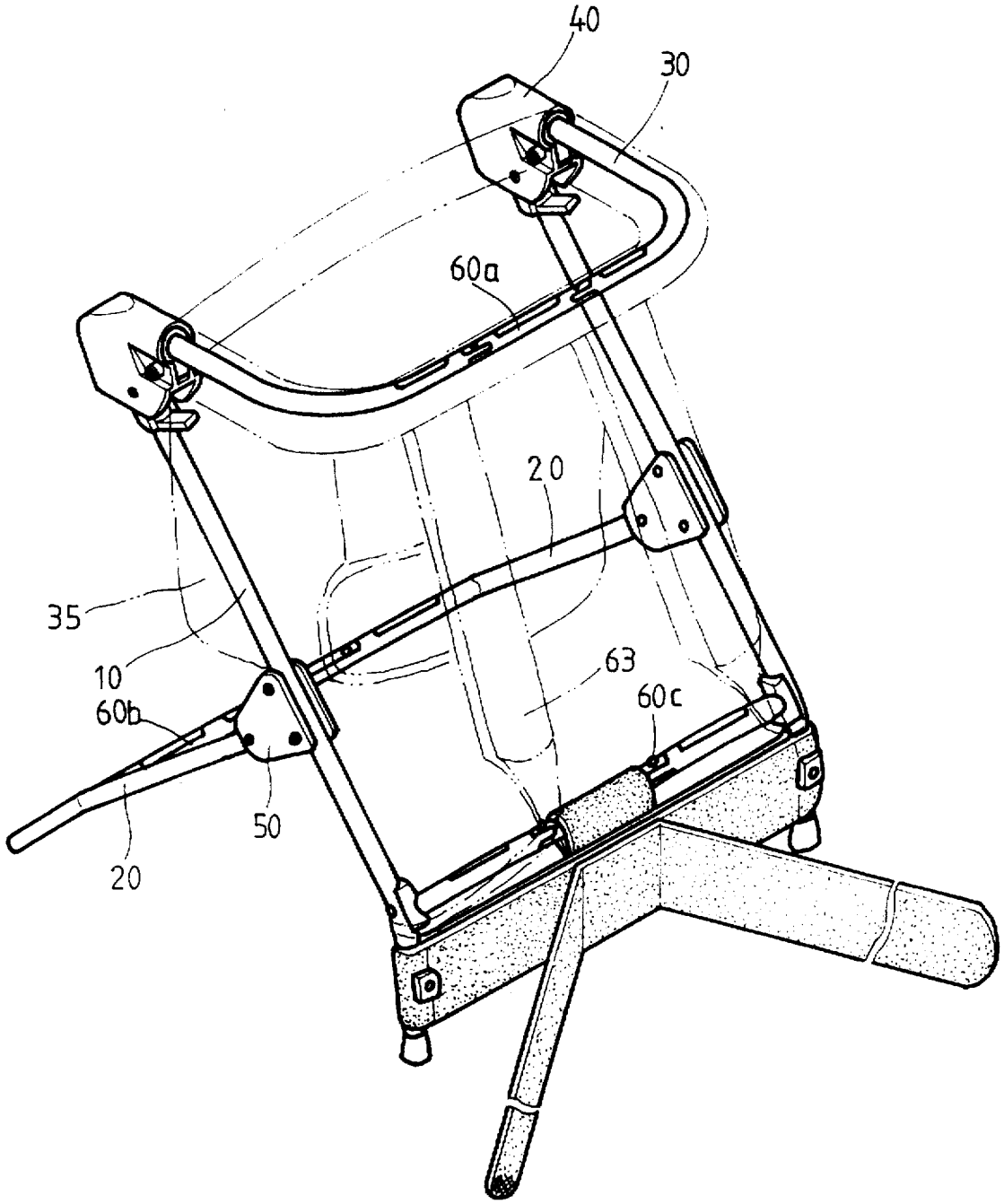
FIG. 3 is a perspective assembly view of a foldable carrier of a preferred embodiment in accordance with the invention.

Referring to FIGS. 3 to 9, a foldable baby carrier comprises first and second support rods 10, a U-shaped upper frame 30, a U-shaped lower frame 20, first and second upper joints 40, and first and second lower joints 50.

Figure 7:
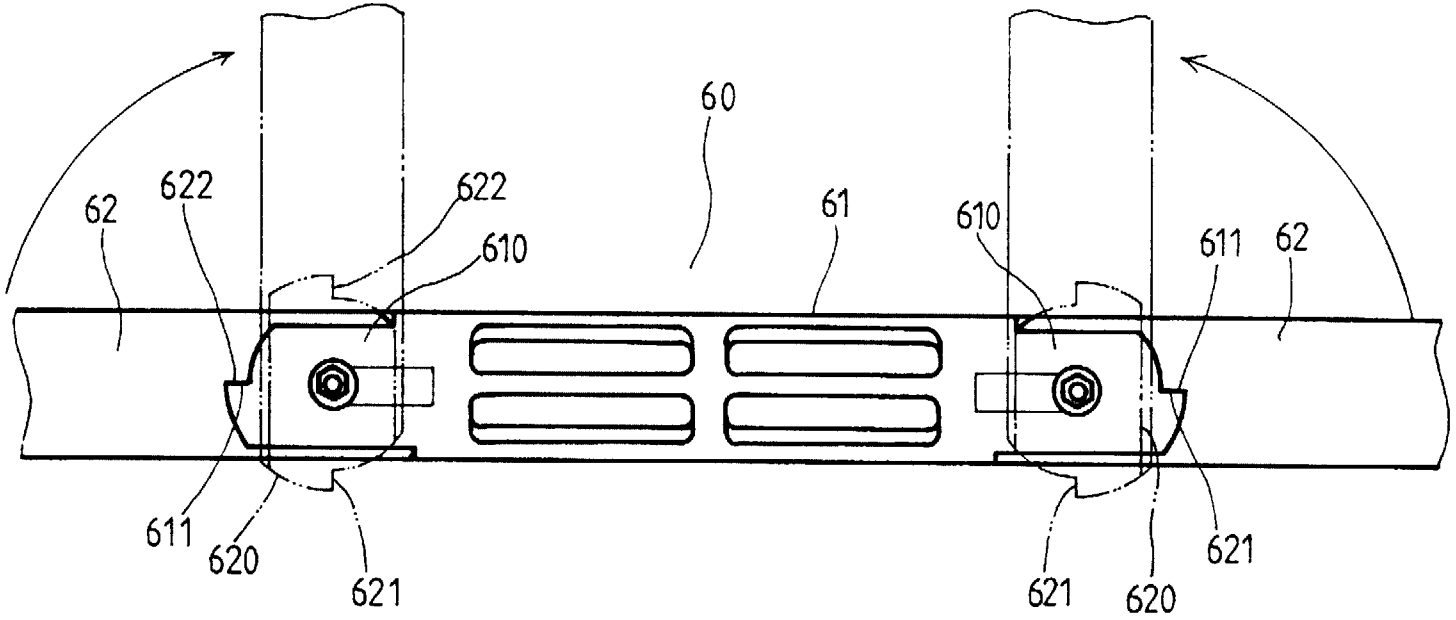
FIG. 7 is a partially elevational view of a foldable rod.
Figure 8:
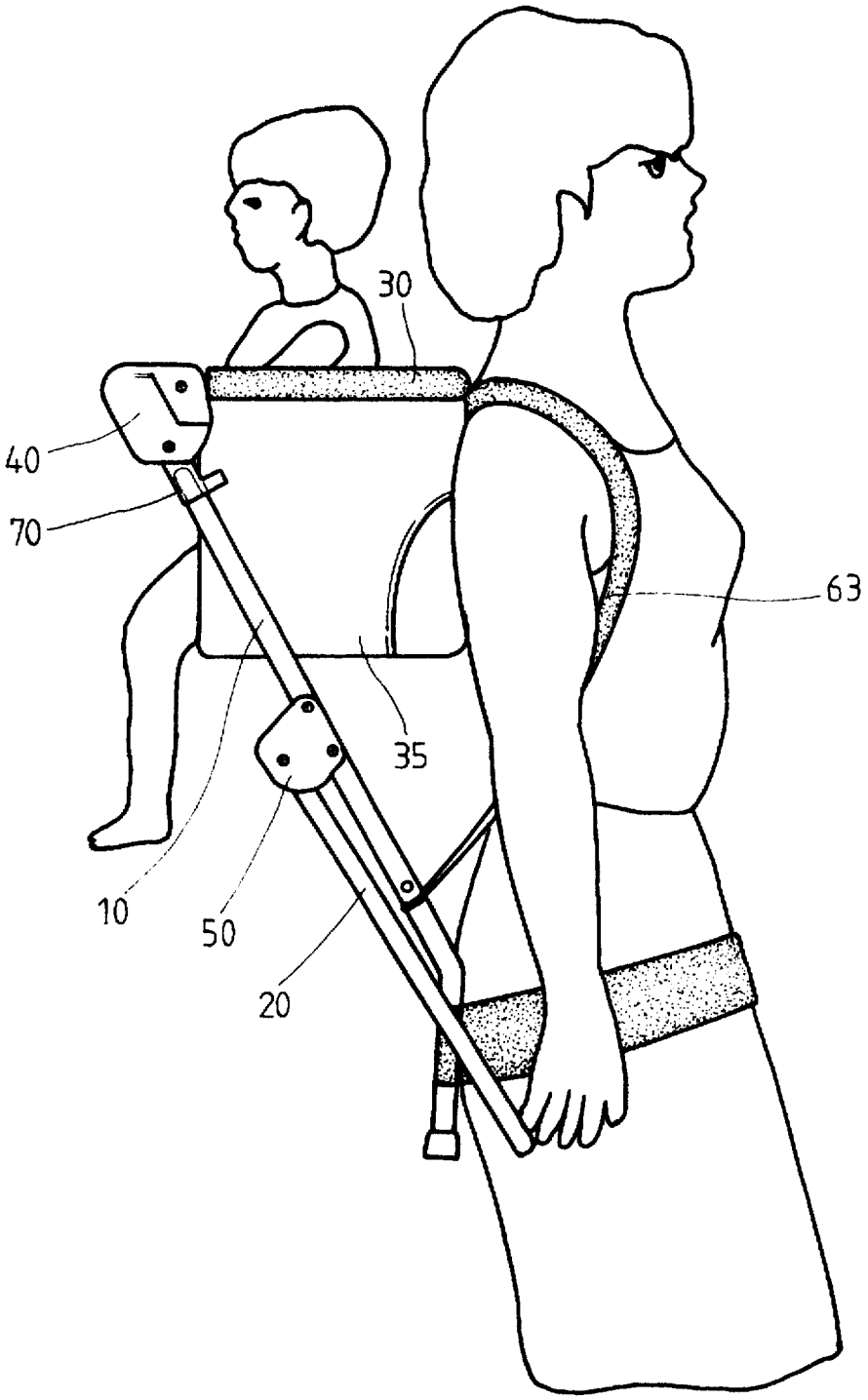
FIG. 8 is a schematic view illustrating a foldable carrier carried by a user.

A foldable rod is designated as numeral 60 in FIG. 7. The structure of the foldable rod 60 is the same as the structures of the first, second and third foldable rods **60*a*, 60*b* and 60*c* in FIG. 3**.

The U-shaped upper frame 30 has a first end and a second end. The first support rod 10 has an upper end and a lower end. The second support rod 10 has an upper end and a lower end. The first end of the U-shaped upper frame 30 and the upper end of the first support rod 10 are connected to the first upper joint 40. The second end of the U-shaped upper frame 30 and the upper end of the second support rod 10 are connected to the second upper joint 40. The U-shaped lower frame 20 has a first end and a second end. The first lower joint 50 is disposed on a middle portion of the first support rod 10. The second lower joint 50 is disposed on a middle portion of the second support rod 10. The first end of the U-shaped lower frame 20 is connected to the first lower joint 50. The second end of the U-shaped lower frame 20 is connected to the second lower joint 50. A first protective sleeve 32 encloses the first end of the U-shaped upper frame 30. A first block 321 is disposed in the first protective sleeve 32. The first protective sleeve 32 and the first end of the U-shaped upper frame 30 are fastened by a first rivet 31. A second protective sleeve 32 encloses the second end of the U-shaped upper frame 30. A second block 321 is disposed in the second protective sleeve 32. The second protective sleeve 32 and the second end of the U-shaped upper frame 30 are fastened by a second rivet 31. The first foldable rod **60*a* is disposed in a middle portion of the U-shaped upper frame 30. The second foldable rod 60*b* is disposed in a middle portion of the U-shaped lower frame 20. The third foldable rod 60*c* has a first end and a second end. The first end of the third foldable rod 60*c* is connected to a lower portion of the first support rod 10. The second end of the third foldable rod 60*c* is connected to a lower portion of the second support rod 10. A first slide sleeve 70 encloses the upper end of the first support rod 10. A second slide sleeve 70 encloses the upper end of the second support rod 10. A first protrusion 71 is disposed on a top portion of the first slide sleeve 70. A first contact plate 72 is disposed on a lower end of the first slide sleeve 70. First slide slot 73 is formed on the first slide sleeve 70. A first and second block plates 74 extend downward from the top portion of the first slide sleeve 70. A first elastic element 76 is inserted in the first slide sleeve 70. A second slide slot 73 is formed on the second slide sleeve 70. Third and fourth block plates 74 extend downward from the top portion of the second slide sleeve 70. A second elastic element 76 is inserted in the second slide sleeve 70. The first slide sleeve 70 and the first support rod 10 are fastened by a first fastening element 75. The second slide sleeve 70 and the second support rod 10 are fastened by a second fastening element 75. The first upper joint 40 has a first groove 41 to receive the first protective sleeve 32, a second groove 42 to receive the first slide sleeve 70, a first recess 45 to receive the first protrusion 71, and a first slide wall 46 and a first block wall 47 under the first recess 45. The second upper joint 40 has a third groove 41 to receive the second protective sleeve 32, a fourth groove 42 to receive the second slide sleeve 70, a second recess 45 to receive the second protrusion 71, and a second slide wall 46 and a second block wall 47 under the second recess 45. A first threaded rod 43 passes through the first block 321 to fasten the first upper joint 40 and the first protective sleeve 32 together. A first threaded bar 44 passes through the first slide slot 73 to fasten the first upper joint 40, the first support rod 10 and the first slide sleeve 70 together. A second threaded rod 43 passes through the second block 321 to fasten the second upper joint 40 and the second protective sleeve 32 together. A second threaded bar 44 passes through the second slide slot 73 to fasten the second upper joint 40, the second support rod 10 and the second slide sleeve 70 together. The foldable rod 60 has a main shaft 61, and first and second auxiliary shafts 62. The main shaft 61 has a first pivot end 610 and a second pivot end 610. The first auxiliary shaft 62 has a third pivot end 620. The second auxiliary shaft 62 has a fourth pivot end 620. The first pivot end 610 has a first protruded block portion 611. The second pivot end 610 has a second protruded block portion 62. The third pivot end 620 has first and second stopper portions 621 and 622. The fourth pivot end 620 has third and fourth stopper portions 621 and 622. The first pivot end 610 and the third pivot end 620 are connected pivotally. The second pivot end 610 and the fourth pivot end 620** are connected pivotally.

It is an option to provide a seat pad 35. An upper periphery of the seat pad 35 is attached to the U-shaped upper frame 30. It is another option to provide two shoulder straps 63. Each shoulder strap 63 has an upper end attached to the first foldable rod **60*a***.

Figure 4:
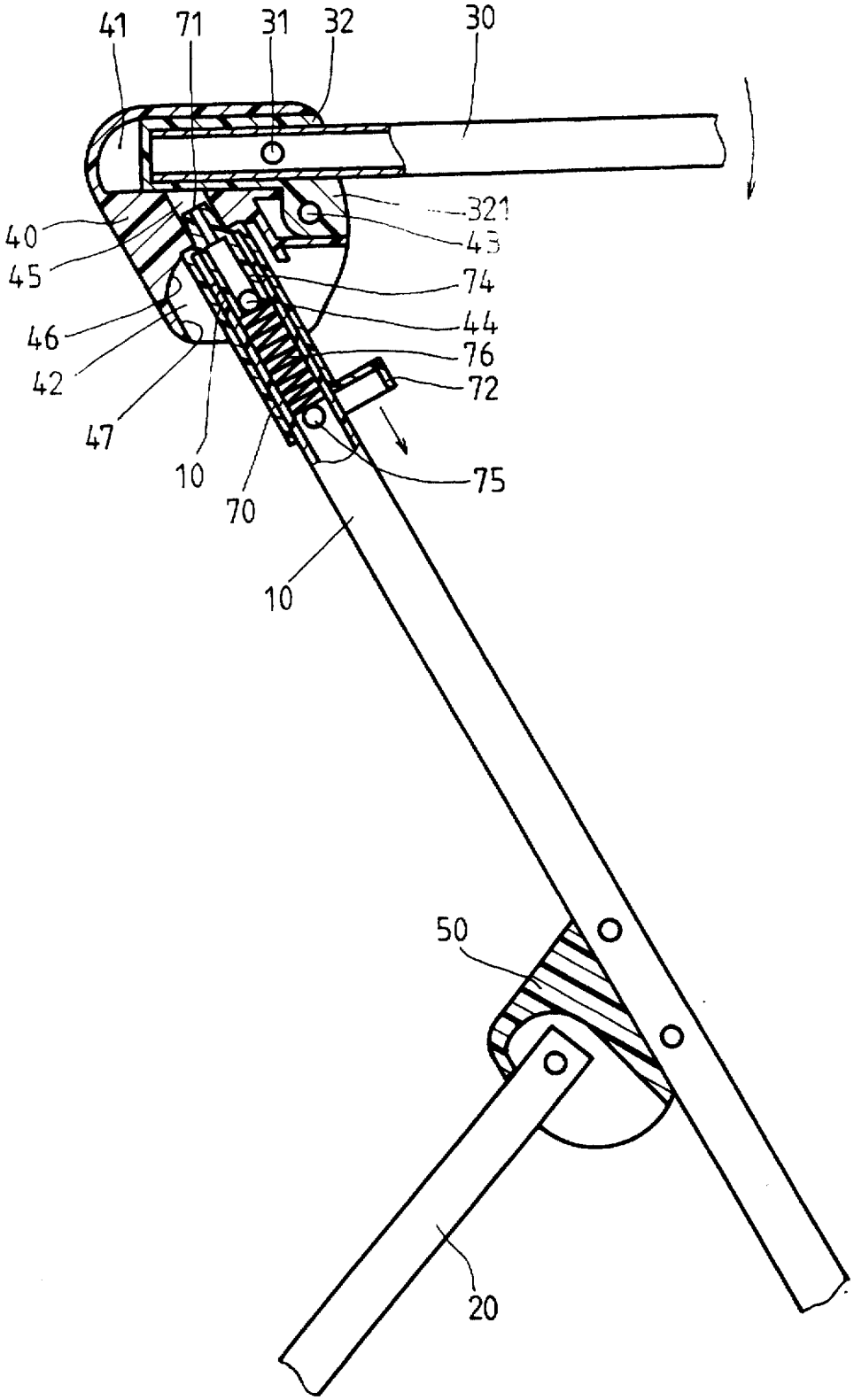
FIG. 4 is a partially sectional view of a foldable carrier of a preferred embodiment while the foldable carrier is unfolded.
Figure 5:
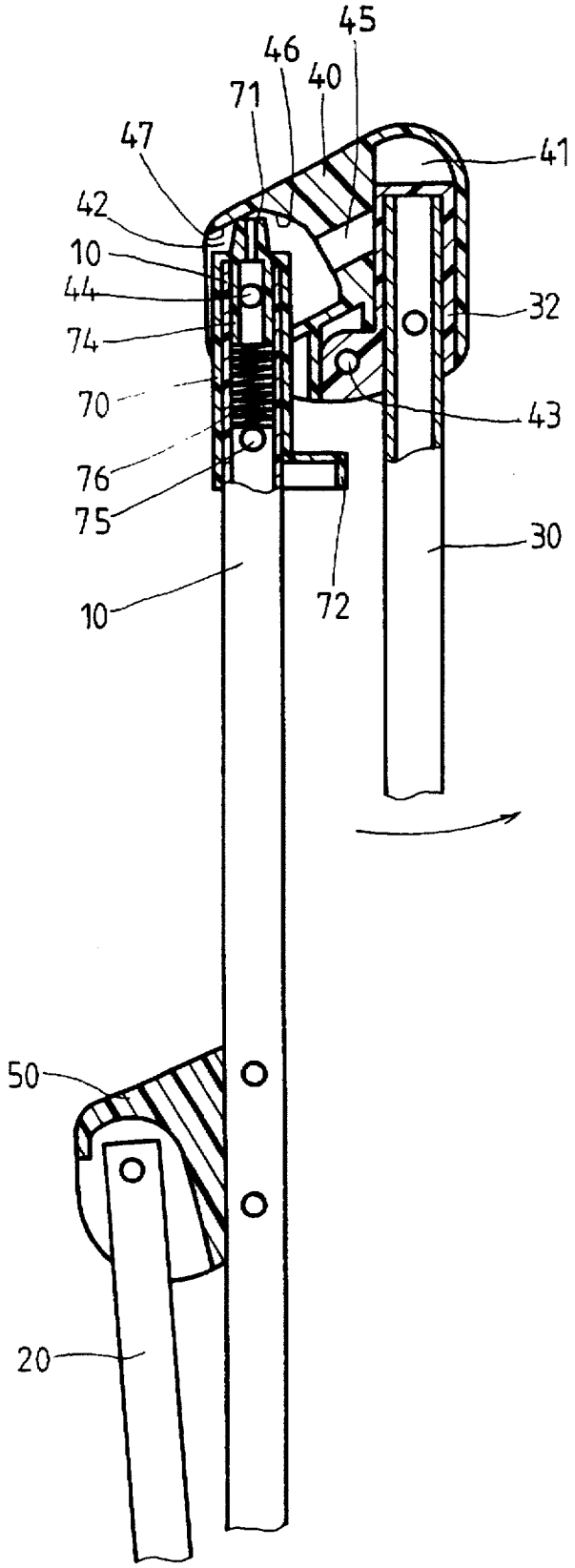
FIG. 5 is a partially sectional view of a foldable carrier of a preferred embodiment while the foldable carrier is folded.
Figure 6:
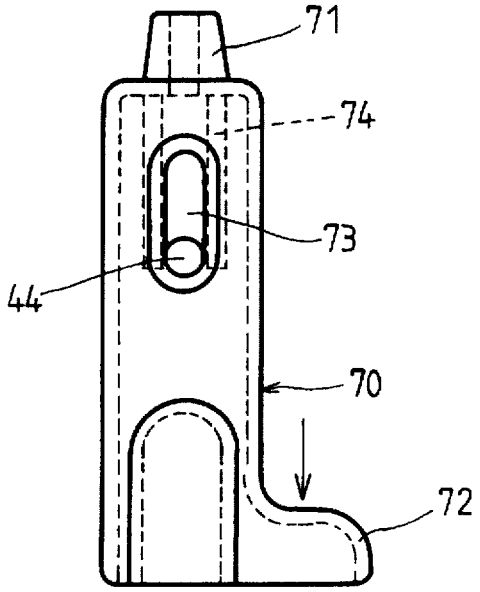
FIG. 6 is a schematic view illustrating an operation of a slide sleeve.
Figure 9:
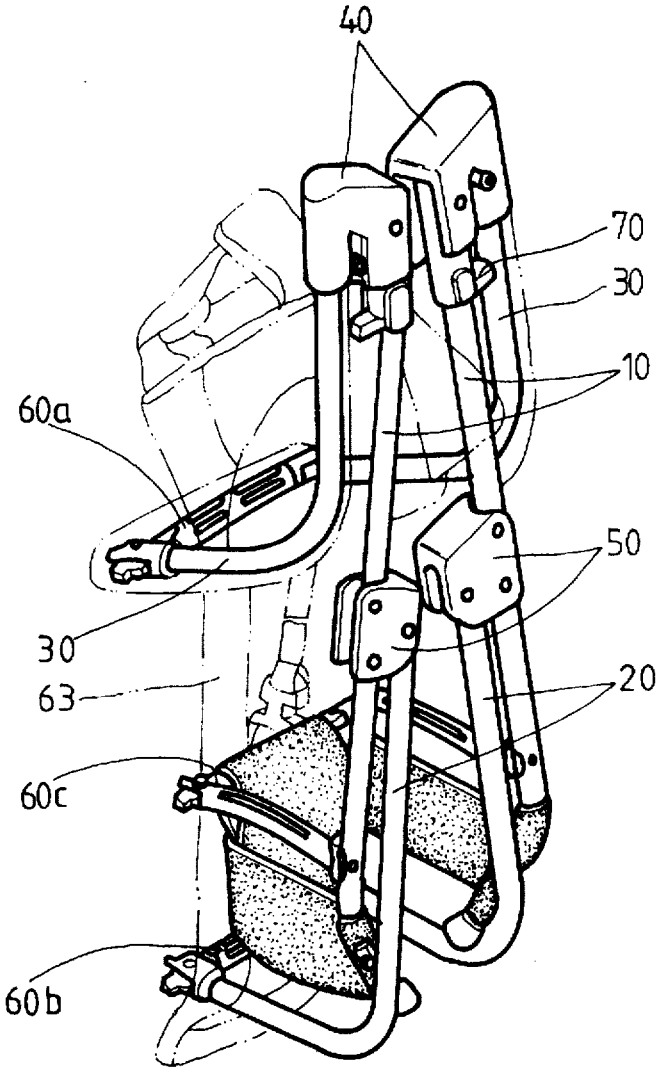
FIG. 9 is a perspective assembly view of a foldable carrier while the foldable carrier is folded.

Referring to FIG. 4, the first and second contact plates 72 are pressed downward to move the first and second slide sleeves 70 downward so that the first and second elastic elements 76 are compressed and the first and second protrusions 71 disengage from the corresponding first and second recesses 45. The U-shaped upper frame 30 is pressed downward toward the first and second support rods 10. Each first pivot end 610 rotates ninety degrees against each third pivot end 620 and each second pivot end 610 rotates ninety degrees against each fourth pivot end 620 to form a compact configuration (as shown in FIGS. 7 and 9).

The invention is not limited to the above embodiment but various modification thereof may be made.

I claim:

1. A foldable baby carrier comprising:

first and second support rods, a U-shaped upper frame, a U-shaped lower frame, first and second upper joints, and a first and second lower joints, the U-shaped upper frame having a first end and a second end, the first support rod having an upper end and a lower end, the second support rod having an upper end and a lower end, the first end of the U-shaped upper frame and the upper end of the first support rod being connected to the first upper joint, the second end of the U-shaped upper frame and the upper end of the second support rod being connected to the second upper joint, the U-shaped lower frame having a first end and a second end, the first lower joint being disposed on a middle portion of the first support rod, the second lower joint being disposed on a middle portion of the second support rod, the first end of the U-shaped lower frame being connected to the first lower joint, the second end of the U-shaped lower frame being connected to the second lower joint, a first protective sleeve enclosing the first end of the U-shaped upper frame, a first block disposed in the first protective sleeve, the first protective sleeve and the first end of the U-shaped upper frame being fastened by a first rivet, a second protective sleeve enclosing the second end of the U-shaped upper frame, a second block disposed in the second protective sleeve, the second protective sleeve and the second end of the U-shaped upper frame being fastened by a second rivet, a first foldable rod disposed in a middle portion of the U-shaped upper frame, a second foldable rod disposed in a middle portion of the U-shaped lower frame, a third foldable rod having a first end and a second end, the first end of the third foldable rod being connected to a lower portion of the first support rod, the second end of the third foldable rod being connected to a lower portion of the second support rod, each of the first, second and third foldable rods having a main shaft, and first and second auxiliary shafts, each said main shaft having a first pivot end and a second pivot end, each said first auxiliary shaft having a third pivot end, each said second auxiliary shaft having a fourth pivot end, each said first pivot end having a first protruded block portion, each said second pivot end having a second protruded block portion, each said third pivot end having a first and second stopper portions, each said fourth pivot end having a third and fourth stopper portions, each said first pivot end being connected to each said corresponding third pivot end pivotally, each said second pivot end being connected to each said corresponding fourth pivot end pivotally, a first slide sleeve enclosing the upper end of the first support rod, a second slide sleeve enclosing the upper end of the second support rod, a first protrusion disposed on a top portion of the first slide sleeve, a first contact plate disposed on a lower end of the first slide sleeve, a first slide slot formed on the first slide sleeve, a first and second block plates extending downward from the top portion of the first slide sleeve, a first elastic element inserted in the first slide sleeve, a second slide slot formed on the second slide sleeve, a third and fourth block plates extending downward from the top portion of the second slide sleeve, a second elastic element inserted in the second slide sleeve, the first slide sleeve and the first support rod being fastened by a first fastening element, the second slide sleeve and the second support rod being fastened by a second fastening element, the first upper joint having a first groove to receive the first protective sleeve, a second groove to receive the first slide sleeve, a first recess to receive the first protrusion, and a first slide wall and a first block wall under the first recess, the second upper joint having a third groove to receive the second protective sleeve, a fourth groove to receive the second slide sleeve, a second recess to receive the second protrusion, and a second slide wall and a second block wall under the second recess, a first threaded rod passing through the first block to fasten the first upper joint and the first protective sleeve together, a first threaded bar passing through the first slide slot to fasten the first upper joint, the first support rod and the first slide sleeve together, a second threaded rod passing through the second block to fasten the second upper joint and the second protective sleeve together, a second threaded bar passing through the second slide slot to fasten the second upper joint, the second support rod and the second slide sleeve together, and wherein the first and second control plates are pressed downward to move the first and second slide sleeves downward so that the first and second elastic elements are compressed and the first and second protrusions disengage from the corresponding first and second recesses, the U-shaped upper frame is pressed downward toward the first and second support rods, each first pivot end rotates ninety degrees against each third pivot end and each second pivot end rotates ninety degrees against each fourth pivot end to form a compact configuration.

2. A foldable baby carrier as claimed in claim 1, wherein a seat pad is attached the U-shaped upper frame.

3. A foldable baby carrier as claimed in claim 1, wherein two shoulder straps are attached to the first foldable rod.

* * * * *